United States Patent [19]

Hunt

[11] 3,959,834

[45] June 1, 1976

[54] SLEEPING BAG CONSTRUCTION

[75] Inventor: Harry Hunt, Boulder, Colo.

[73] Assignee: Alpine Designs, Inc., Boulder, Colo.

[22] Filed: Dec. 27, 1974

[21] Appl. No.: 536,813

Related U.S. Application Data

[62] Division of Ser. No. 362,497, May 21, 1973, Pat. No. 3,857,125.

[52] U.S. Cl. ..... 5/343; 2/69.5

[51] Int. Cl.² ..... A47G 9/00

[58] Field of Search ..... 5/343, 334 R, 336; 2/69.5

[56] References Cited

UNITED STATES PATENTS 2,656,540 10/1953 Stephenson ..... 5/343 X 3,584,323 6/1971 Worley ..... 5/343

FOREIGN PATENTS OR APPLICATIONS 514,531 2/1955 Italy ..... 5/343

*Primary Examiner*—Paul R. Gilliam
*Assistant Examiner*—Andrew M. Calvert
*Attorney, Agent, or Firm*—Elliot A. Lackenbach

[57] ABSTRACT

Mummy-type insulated sleeping bag, particularly for Winter, Alpine and other severe weather, providing unusual loft and warmth with minimal weight, elimination of coldspots or areas of reduced insulation thickness and suitable for efficient use by persons of differing physiques by self-adjusting compensation therefor.

2 Claims, 7 Drawing Figures

SLEEPING BAG CONSTRUCTION

This is a division, of application Ser. No. 362,497 filed May 21, 1973, now U.S. Pat. No. 3,857,125.

The present invention relates generally to sleeping bags and, more particularly, to sleeping bags of superior warmth and versatility.

Quilted sleeping bags are utilized to provide warmth and comfort to persons who of either necessity or sport sleep out of doors or in unheated quarters. In many outdoor activities it is highly desirable that the weight and bulk of the sleeping bag be as small as possible while still providing sufficient warmth and protection to the user. Sleeping bags designed for extreme weather conditions, such as are encountered in wilderness travel and mountaineering epitomize the almost inherent conflicting requirements, i.e., low weight and low bulk when packed versus the necessity for providing very efficient insulation and great warmth and thickness when in use.

For example, still air temperatures in the mountains of the United States of 30° to 50° Fahrenheit below zero are not uncommon and still air temperatures in Northern Canada and Alaska are often even lower. Further, high winds may often also be present which further depress effective air temperature. At the same time, since a substantial amount of gear and equipment in addition to the sleeping bag must also be carried, often by back-pack and without assistance, keeping the weight of the sleeping bag to a minimum is highly important to such use. In addition to mere warmth, however, a sleeping bag must be porous so that moisture can escape and for maximum comfort, the bag should be adjustable by the user to provide varying degrees of warmth and/or venting of excess heat generated within the bag so as to be usable under conditions of varying severity.

In recent years substantially all high grade sleeping bags of the general type referred to have utilized down, particularly northern goose down, as the insulating filler material between layers of thin flexible fabric in various quilting arrangements. The fabric shell material often consists of rip-stop nylon of extremely light gauge typically of a weight of approximately 1.1 ounce per square yard. While in sleeping bags for moderate conditions the inner and outer shell layers may be through-stitched or quilted, in sleeping bags for extreme conditions various means are utilized to attempt to provide a substantially uniform thickness of insulation by the elimination of through-quilting seams. Hence, it has been suggested to superimpose two through-quilted sleeping bags, one within the other, with the seams being offset. Generally, however, in order to provide for increased efficiency at lower weight, rather than two separate inner and outer sleeping bags being provided, a somewhat analagous structure is formed by utilizing a single thin layer of baffle material zig-zag between the shell layers to provide a plurality of overlapping compartments to be filled with the down insulation. Hence, only a single baffle layer is necessary, rather then the two baffle layers necessary with completely separate inner and outer bags and, since the baffle layer need not be down proof, but merely resistant to the shifting of down therethrough, substantial savings in weight may be accomplished.

Northern down is the preferred material for fill of such sleeping bags for several reasons. Firstly, and most importantly, down in almost unique in its ability to loft, that is, to swell after compression. On the other hand, down is very highly compressible so that using construction such as that described herein, it is perfectly feasible to provide a sleeping bag providing four to five inches of insulation completely around the body which may be readily compressed and stored in a stuff bag eight inches in diameter by 16 or 18 inches depth.

Such a bag may provide comfort in temperatures substantially below zero degrees Fahrenheit and may weight under five pounds.

The high compressibility of down, however, provides a very important limitation to design. Since the down is so highly compressible, any restriction whatsoever in the shell design restricts the lofting and reduces the efficiency of the down as an insulating material. Moreover, stresses introduced by the design or by the presence of an occupant within the bag are readily transmitted and result in compression of the down. Moreover, while maximum efficiency of insulation is achieved by form-fitting of the inner bag to the specific contours of the occupant so as to completely eliminate air spaces around his body within the bag, comfort dictates that, in at least a portion of the bag, the occupant have freedom of movement. In such areas or regions, however, it is desirable that any such movement of the occupant does not affect compression of the down.

Bearing in mind the foregoing, it is a primary object of the present invention to provide novel and improved sleeping bags which are light in weight, compressible to require little space when packed, provide great warmth when needed, enable proper venting of moisture, and be suitable for Arctic and mountaineering use.

Another primary object of the present invention, in addition to the foregoing object, is the provision of such sleeping bags which are quilted in a manner to provide unusual loft and efficiency of insulation.

Yet another primary object of the present invention, in addition to each of the foregoing objects, is the provision of such sleeping robes characterized by a complete absence of "cold spots".

Still another primary object of the present invention, in addition to each of the foregoing objects, is the provision of such sleeping bags incorporating a maximum and generally uniform amount and thickness of insulation around the user.

A still further primary object of the present invention, in addition to each of the foregoing objects, is the provision of a down-filled draft tube disposed inside of a sleeping bag along the zipper and extending all the way to the foot of the bag beyond the end of the zipper.

Yet another primary object of the present invention, in addition to each of the foregoing objects, is the provision of a channel block disposed along the side seam of the bag providing a full thickness of insulation thereat.

A further primary object of the present invention, in addition to each of the foregoing objects, is the provision of a sleeping bag having a differentially cut region extending generally from beneath the shoulders of an occupant to the foot region to insure uniform loft and help prevent user-created cold spots.

Yet still another primary object of the present invention, in addition to each of the foregoing objects, is the provision of self-adjusting shoulder regions in a sleeping bag which are non-differentially cut, providing a full thickness of insulation over the occupant's shoulders.

Another and still further primary object of the present invention, in addition to each of the foregoing objects, is the provision of sleeping bags having novel and improved construction to provide shoulder coverage even when the hood is not drawn and which improves the closure of the hood when drawn around the face.

Another and yet still further primary object of the present invention, in addition to each of the foregoing objects, is the provision of novel and improved means for enabling a separate drawing of the hood and neck areas of a sleeping bag.

Another still further primary object of the present invention, in addition to each of the foregoing objects, is the provision of novel and improved neckline construction precluding tapering of the insulation thereat.

Yet another and still further primary object of the present invention, in addition to each of the foregoing objects, is the provision of novel and improved means for enabling closure of the sleeping bag over the shoulders of an occupant while yet permitting the side zipper thereof to be opened for ventilation.

Another and still further primary object of the present invention, in addition to each of the foregoing objects, is the provision of stiffening means in the draft tube of the sleeping bag to aid in preventing snagging thereof in the zipper teeth and a zipper tab connected with the bottom of the zipper tape to facilitate opening of the zipper on the bottom.

Still another and yet further primary object of the present invention, in addition to each of the foregoing objects, is the provision in sleeping bags of the class described of fully baffled differentially cut foot portions.

A yet further primary object of the present invention, in addition to each of the foregoing objects, is the provision of sleeping bags of the class described having two-way fully separating zippers enabling such bags to be zipped together while yet providing insulation over both shoulders of two occupants.

The invention resides in the combination, construction, arrangement and disposition of the various component parts and elements incorporated in improved sleeping bags or robes constructed in accordance with the principles of this invention. The present invention will be better understood and objects and important features other than those specifically enumerated above will become apparent when consideration is given to the following details and description, which when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved especially as they fall within the scope and spirit of the subjoined claims.

Figures 1, 2, 3:
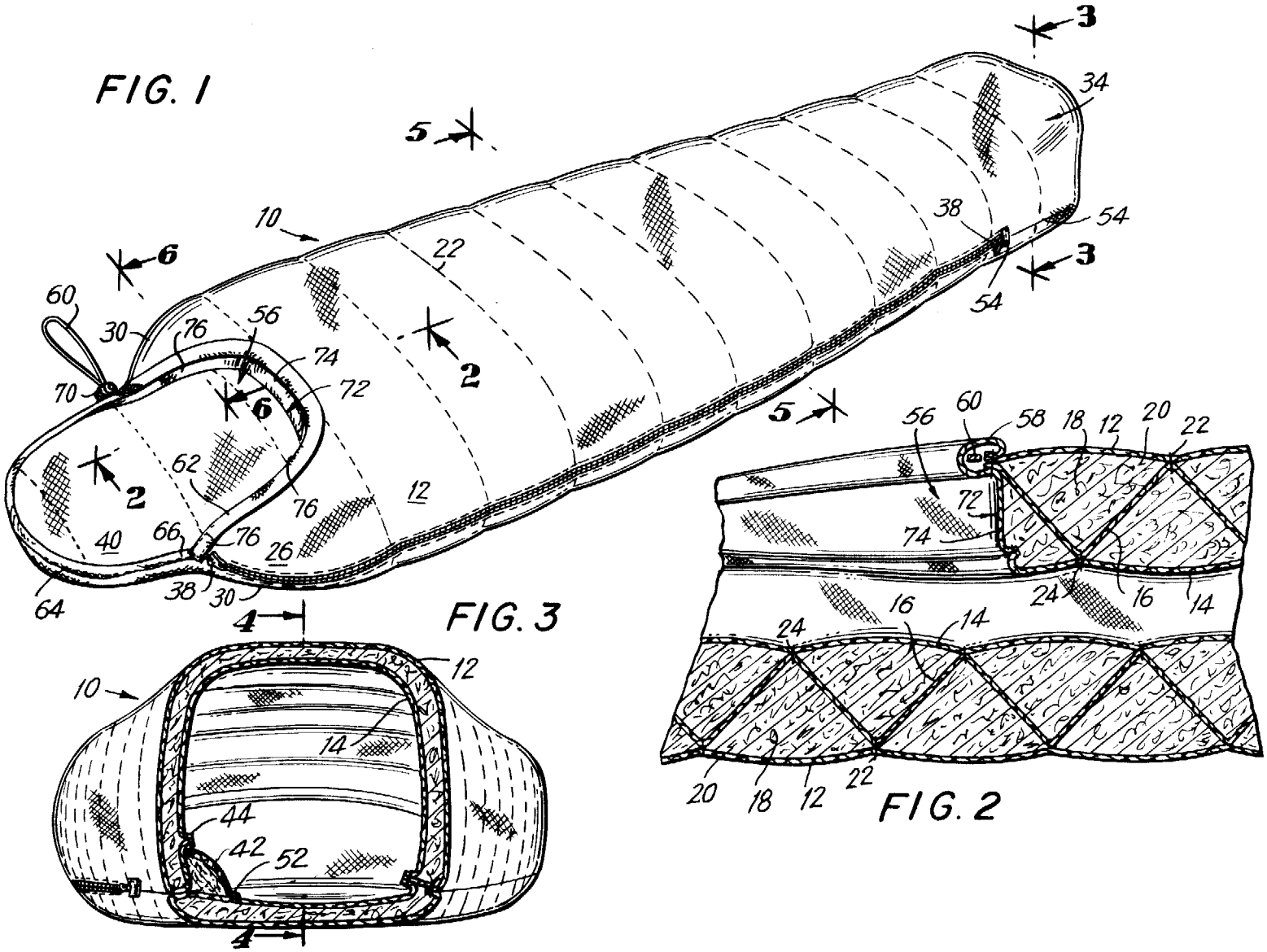
FIG. 1 is an isometric illustration of a novel and improved sleeping bag constructed in accordance with the present invention.
FIG. 2 is an enlarged partial cross-sectional illustration taken along line 2—2 of FIG. 1.
FIG. 3 is an enlarged cross-sectional elevational view taken along 3—3 of FIG. 1.

With reference now to the drawing, there is shown and illustrated a sleeping bag constructed in accordance with the principles of the present invention and designated generally by the reference character 10 which is of a quilted construction and which may be fabricated of an outer fabric or shell layer 12, an inner fabric or shell layer 14 and a baffle fabric layer 16 which divides the space between the outer fabric layer or shell 12 and the inner fabric layer or shell 14 into a plurality of tubes 18 which may be filled with a compressible fill material such as goosedown 20 to provide a lofting thereof and maintain a separation between the outer fabric layer or shell 12 and the inner fabric layer or shell 14. The baffle fabric layer 16 may be sewn to the shell layers 12 and 14 along seam lines 22 and 24, respectively, to provide a limitation to the separation therebetween.

As has long been realized, dry air is an excellent thermal insulator against transfer of heat through conduction. Dry air, however, unless restrained against circulation is a fairly good transfer medium for heat through convection. At body temperatures and below, the transfer of heat through dry air by radiation between the inner and outer fabric panels 14 and 12, respectively, is very small. Hence, the most effective insulation for a sleeping bag or other similar construction is to provide a trapped large mass of air between the fabric layers and then prevent the transfer of heat therewithin by convection. It has been found that fluffy fill materials between the fabric layers ideally fulfill these requirements. While various fill materials may be utilized, and while where weight and bulk are not of prime importance there are many excellent artificial fibers suitable, where weight and bulk of the packed item are important, as in sleeping bags for mountaineering and backpacking use, no other material has yet been found which surpasses Northern goose down in desirability.

While natural down has the advantage of being very easily compressed to a small fraction of its free or loose volume while yet rapidly lofting or rebounding to its free height, this ease of compressibility does, to some extent, present problems. For example, because of the ease with which down is compressed, the fabric layers must be loose, if the low lofting power of the down is to provide full lofting.

Since, as heretofore pointed out, the air between the outer and inner fabric layers or shells 12 and 14 is actually the medium which performs the insulation, the filling being primarily to support the outer and inner fabric layers or shells 12 and 14 apart and to preclude the movement due to convection of the air therebetween, the primary function of the inner baffle material 16 is to confine the down to a desired location, prevent shifting thereof so as to enable the down to most fully fill the space between the outer and inner fabric layers or shells 12 and 14 and to define the maximum spacing therebetween.

Inasmuch as the inside of the bag 10 must always be smaller than the outside, it has been suggested that it is wasteful of material to make the inside shell 14 identical in configuration to the outside shell 12. Hence, the inside shell 14 is made smaller than the outside shell 12 and if properly proportioned, is smaller than the outside shell 12 by a spacing equal to the desired loft of the down 20. Hence, with the inside shell 14 being so proportioned, both the inside shell 14 and the outside shell 12 are smooth and remain spaced apart by the designed lofting of the bag. Such a construction is called differential cut due to the differential or proportioning of the patterns utilized for the outside shell 12 and the inside shell 14.

Designing the shells 12 and 14 with a differential cut has a further advantage, namely, that if pressure is applied to the inside shell 14 outwardly, as by an occupant's knees, elbows, or the like, the entire baffle assembly and outer shell 12 is also shifted thereby to maintain the substantial full thickness of insulation in general alignment with the point of pressure on the inside shell 14. In a non-differentially cut construction, since the inside shell 14 is substantially the same size as the outside shell 12, localized pressure against the inside shell does not cause such shifting and the inside shell 14 does not resist localized pressure so that the down or fill 20, around such localized pressure is compressed, resulting in a cold spot with decreased insulation.

Differential cutting, however, does introduce a source of decreased efficiency in that the interior shape of the bag is defined by the shape of the inner shell 14 as supported by the lofted down between the inner and outer shells 14 and 12, respectively. In actual practice, some sagging of the inner shell 14 necessarily occurs so that a bag designed as a differentially cut bag in actual fact is somewhat of a compromise. Any such sagging of the inner shell 14 is considered, generally, however, as a practicality which must be lived with and by adherence to differential cutting is looked upon and thought of as a phenomenon to be reduced or eliminated.

In a differentially cut bag, however, the interior configuration is primarily defined by the cut, substantially independent of the contours of the occupant of the bag and large air spaces are created within the bag but particularly where abrupt changes in contour occur such as around an occupant's legs, between his arms and his torso, and the like. Such large masses of air provide two distinct disadvantages. Firstly, these masses of air must be warmed by the occupant's body processes. Secondly, since the internal dimensions of the sleeping bag are primarily determined by the cut of the bag, rather than by the size of the occupant, the heat loss from the interior chamber is substantially fixed regardless of the actual size of the occupant contained therein.

A differentially cut bag, however, is free to conform quite closely to the occupant's body contours and the interior thereof therefore becomes substantially self-adjusting to the occupant, eliminating masses of air within the bag to be heated by the occupant's bodily processes and self-adjustably defining a heat transfer surface substantially co-extensive with the surface of the occupant's body.

Hence, each of the differentially-cut and non-differentially cut constructions has advantages and disadvantages and the adherents to one type of construction or the other are legion but differentially cut sleeping bags are entirely differentially cut, while non-differentially cut sleeping bags are substantially non-differentially completely cut or styled.

The present sleeping bag, however, combines the advantages of differentially and non-differentially cut construction, utilizing a differential cut where body movements are likely to occur during sleep so as to preclude the formation of user-created cold spots due to pressures against the inner shell 14. Through the shoulder area, however, where little movement is likely to occur, a non-differential cut is utilized to provide for maximum self-adjustability to the varying contours or physiques of different occupants. Moreover, because a non-differential cut is utilized in the shoulder area in the present sleeping bag the shoulder region may be contoured to provide an outwardly curved over-the-shoulder arcing, arching or bulging of the outer shell 12 due to down pressures therewithin to maintain an effective insulation thickness thereat.

Figure 6:
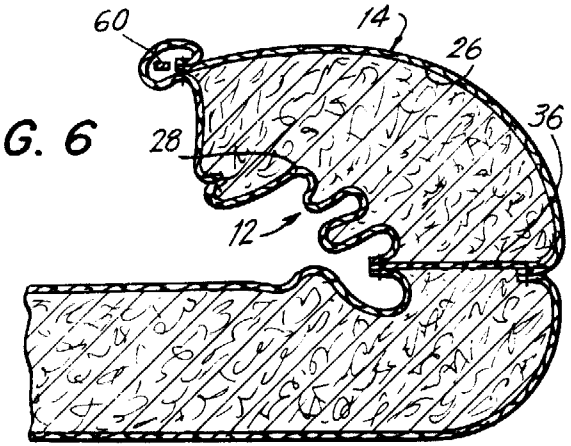
FIG. 6 is an enlarged cross-sectional illustration taken along 6—6 of FIG. 1.
Figure 7:
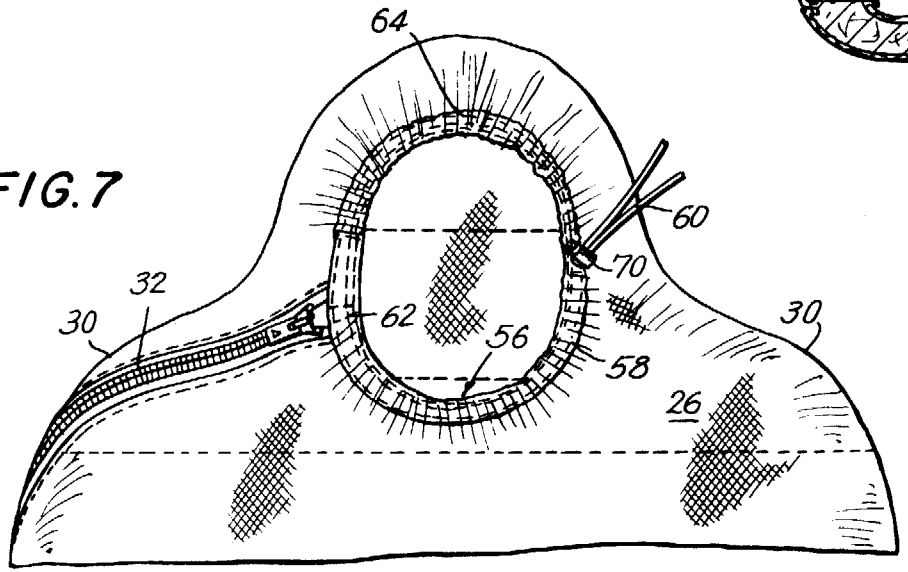
FIG. 7 is an enlarged partial plan view of the hood and shoulder region of the sleeping bag of the present invention showing the hood and neck in the fully drawn configuration thereof.

Accordingly, as particularly shown in FIGS. 1, 6 and 7, the shoulder regions 26 and 28 respectively, of the outer and inner shells 12 and 14, are cut to provide a deeply curved edge 30 arching over the shoulders of the occupant with the shoulder portion 28 of the inner shell 12 being loose and capable of self-adjusting conformation to the contours of an occupant. A seam may be provided along one curved edge 30, the other curved edge being separably fastenable, as by means of a zipper 32 associated therewith and extending down the side of the sleeping bag towards the foot 34 thereof. The zipper 32 may extend along the shoulder edge 30 or may, as shown in FIG. 7, be disposed slightly forwardly thereof for ease of operation by the occupant.

Figure 5:
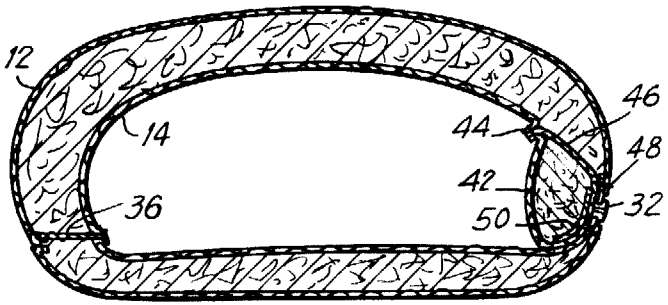
FIG. 5 is an enlarged cross-sectional illustration taken along 5—5 of FIG. 1.

As shown in FIGS. 5 and 6, a channel block 36 may be provided joining the inner and outer shells 12 and 14, respectively, at the side opposite the zipper 32, fabricated of material similar to that utilized for the baffles 16 and providing a full thickness of insulation at the side of the bag. The channel block 36 prevents down shifting from the top to the bottom of the bag.

The zipper 32 is preferably of the double slider, fully-separating variety, having a slider 38 at each end portion thereof and oppositely facing from one another enabling the ventilation to be controlled when desired and enabling a pair of bags to be zipped together for a pair of occupants. The "over the shoulder" construction provides, even when two sleeping bags are zipped together, an enhanced insulation between the occupants and over both of their adjacent shoulders. The over the shoulder construction accordingly provides complete shoulder coverage even when the hood portion 40 is generally flat, as shown in FIG. 1 and improves the closure of the hood portion 40 when drawn around the face, as shown in FIG. 7.

In order to prevent a cold spot along the zipper 32, a baffle tube 42 may be provided sewn to the inner shell 14 along the inside of the zipper 32. As particularly shown in FIG. 5, the baffle or draft tube 42 is sewn to the inner shell 14 along a seam 44 spaced apart from the zipper 32 so as to define a portion of 46 of the inner shell 14 functioning equivalent to the channel block 36 and precluding tapering or compressing of the down adjacent the zipper 32. As shown, the baffle or draft tube 42 may be further sewn to the zipper tape along a seam 48. The baffle or draft tube 42 may be further provided with a stiffening tape 50 of relatively stiff material such as is conventionally used as an interlining, or the like, extending along the inside of the zipper 32 to aid in supporting the draft tube 42 in extended position while yet substantially precluding catching of the material thereof between the teeth of the zipper 32. The baffle or draft tube 42 is filled with down 20. Accordingly, the baffle or draft tube 42, with its down insulation 20, provides a full thickness of insulation behind the zipper 32.

Moreover, as particularly shown in FIG. 3, the baffle or draft tube 42 is extended beyond the lower end portion of the zipper 32 and into the foot portion 34 of the bag 10 whereat it is sewn, along a seam 52, to the inner shell 14 on the other side of the zipper 30 so as to preclude cold air from entering through the zipper 32 and passing into the interior of the bag past the end of the baffle or draft tube 42. Moreover, by such construction the tapering of the sleeping bag along the seam 54 between the end of the zipper 32 and foot of the sleeping bag which generally occurs in conventional constructions, does not produce any lessening of the insulation thereat in the present construction.

Figure 4:
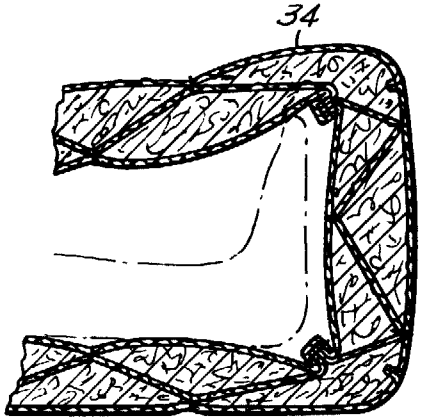
FIG. 4 is an enlarged cross-sectional elevational view taken along 4—4 of FIG. 3.

As more particularly shown in FIG. 4, the sleeping bag of the present construction has a fully baffled and differentially cut foot region 34 to provide for maximum insulation of the occupant's feet while yet enabling transfer of heat between his feet, that is, from one to the other for maximum warmth and comfort.

A pull tab 54 may be provided sewn to the zipper tape at the foot end of the zipper 32 as an aid in facilitating opening of the zipper from the bottom without applying stress to the bag itself.

Accordingly throughout that region of the sleeping bag generally below the shoulder area, the sleeping bag of the present invention is fully differentially cut to provide uniform thickness of insulation and resistance to down compression and the formation of cold spots due to sleeper motions. A substantially uniform thickness of insulation is provided both above the sleeper and along the side due to the unique draft tube and channel block construction and as well as throughout the foot area or region due to the fully baffled differentially cut foot region, as shown.

At the head end of the sleeping bag 10 and extending into the shoulder area 26 there may be provided a generally U-shaped neckline opening 56. The neckline opening 56 is rimmed by means of a fabric tube 58 secured to the outer shell 12 and through which there may extend a drawstring or pull tape 60 extending generally outwardly at a side location as shown in FIG. 1. The end of the pull tape 60 at the saide opposite its outward extension may be secured with the end of the tube 58 so that, upon pulling of the tape 60, the tube 58 and neckline opening 56 will be puckered and tightened, as by means of a line of stitching 62, as shown in FIG. 7. The other end of the pull tape 60 may extend through a similar tube 64 extending around the periphery or rim of the generally U-shaped hood portion 40 and be stitched at the opposite end portion thereof, as by means of stitching 66, so that upon pulling of the tape 60 through the hood tube 64, the hood will be drawn inwardly and puckered to form the hood for over the user's head and provide a facial opening 68 in combination with the puckered neckline opening 56 as shown in FIG. 7. Since the opposite end portions of the tape 60 are, respectively, connected with the neckline tube 58 and the hood tube 64, the adjustment and tightening thereof may be selectively separately controlled. For convenience of maintaining the end portions of the tape 60 pulled as desired, there may be provided a spring clamp lock 70 engaging the tape 60 as shown. The lock 70 may be of substantially any desired construction. To prevent tapering of the sleeping bag 10 generally adjacent the neckline opening 56 and to enable effective sealing of the neck region, particularly below the user's chin, there may be provided connecting the outer shell 12 and the inner shell 14 a gusset panel 72 having a generally uniform width central portion 74 and a pair of tapered portions 76 on opposite sides thereof enabling the neckline portion of the sleeping bag 10 to self-adjustably formfit into the underchin area.

Accordingly, tight, draft-free closure around the entire neck and the shoulder area will be accomplished with the present invention as well as the maintenance of a full thickness of insulation thereat as well as throughout the remainder of the bag.

For ventilation control there may be further provided a tab 76 provided with separable fastener means, such as a Velcro fastener tab extendable along the line of the hood tube 64 and neckline tube 58 across the zipper opening enabling the sleeping bag of the present invention to be maintained in its over the shoulder configuration even when the zipper 32 is open for ventilation.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and the breadth of the claims here appended.

What is claimed is:

1. In a sleeping bag comprising quilted front and back panels sewn together along a portion of a side edge and selectively fastenable together along at least an adjacent portion of said side edge, a baffle tube extending along said side edge entirely longitudinally of both said portions and secured with at least one of said front and back panels entirely longitudinally along both said portions.

2. Sleeping bag defined in claim 1 wherein both said front and back panels comprise inner and outer shell layers, said baffle tube being sewn only to said inner layers.

* * * * *